US005669767A

United States Patent [19]

Bureau et al.

[11] Patent Number: 5,669,767

[45] Date of Patent: Sep. 23, 1997

[54] DEVICE FOR USE WITH AN OIL LAMP TO ALLOW DIFFUSION OF THE SCENT OF A PERFUME ADDED TO THE OIL

[75] Inventors: Jean-Louis Bureau, Charlesbourg; Jacques Bureau, Ste-Anne de Beaupré, both of Canada

[73] Assignee: Rayflam Inc., Sainte-Foy, Canada

[21] Appl. No.: 680,862

[22] Filed: Jul. 16, 1996

Related U.S. Application Data

[60] Provisional application No. 60/001474 Jul. 18, 1995.

[51] Int. Cl. [6] ..... F23D 3/24

[52] U.S. Cl. ..... 431/320; 422/305; 422/125

[58] Field of Search ..... 431/320; 422/305, 422/125

[56] References Cited

U.S. PATENT DOCUMENTS 3,321,938 5/1967 Bureau ..... 67/55

FOREIGN PATENT DOCUMENTS 2693788 1/1994 France .

2080514 2/1982 United Kingdom ..... 431/320

2139342 11/1984 United Kingdom .

*Primary Examiner*—Carroll B. Dority

*Attorney, Agent, or Firm*—Robic

[57] ABSTRACT

Disclosed is a device for use in an oil lamp to allow the diffusion of the scent of a perfume added to the oil. The oil lamp has an inside and a lip lying in a generally horizontal plane. The device is a ring-shaped element having a plurality of inwardly downwardly protruding tabs that are spaced apart to define gaps therebetween permitting uninterrupted air flow between the inside of the bottle and the ambient air. The tabs have free ends defining an opening and are sized and shaped to receive and hold a wick supporting tube having a longitudinal axis perpendicular to the horizontal plane and an upper end from which a wick projects. The tube is inserted into the opening so that the upper end of the wick supporting tube is held in place at a given longitudinal distance from the lip. Thus, when the device is placed on the lip and the wick is lit, heat generated by the lighting of the wick heats the tube and the oil and causes the perfume to be released into the ambient air through the gaps to provide a pleasing smell.

10 Claims, 2 Drawing Sheets

DEVICE FOR USE WITH AN OIL LAMP TO ALLOW DIFFUSION OF THE SCENT OF A PERFUME ADDED TO THE OIL

This application is based upon provisional application U.S. 60/001,474, filed Jul. 18, 1995.

FIELD OF THE INVENTION

The invention is concerned with a device for use with an oil lamp to allow the scent of a perfume added to the oil to be released in the ambient air. The invention is also concerned with the combination of an oil lamp with such a device.

DESCRIPTION OF THE PRIOR ART

Conventionally, oil lamps comprise a glass bottle, at the neck of which is inserted an oil burner head which holds a wick. The oil burner head may include a mechanism to adjust the length of the wick and thus the intensity of the flame, or may include a mechanism to hold the wick in place at a predetermined length without requiring adjustment. Reference may be made to U.S. Pat. No. 3,321,938 for such a mechanism, which discloses an oil burner head having a glass tube through which a wick projects. The oil burner head rests on the lip of the oil lamp.

The glass bottle is filled with oil or liquid paraffin. The oil or liquid paraffin can be perfumed, to provide a pleasing smell when the lamp is lit. However, due to the fact that the oil burner head is inserted inside the glass bottle and that there is no space between the neck of the glass bottle and the oil burner head, the perfume in the oil or liquid paraffin is burned at the same time as the paraffin and thus no odor is released, or if any odor at all, that of burnt perfume.

SUMMARY OF THE INVENTION

An object of the invention is to provide a device which leaves a space between the tube and the lip of the glass bottle to allow the diffusion of the scent of a perfume added to the oil or liquid paraffin to be released in the ambient air without being burned.

In accordance with the invention, this object is achieved with a device for use in an oil lamp having an inside and a lip lying in a generally horizontal plane. The device comprises a ring-shaped element having a plurality of inwardly downwardly protruding tabs that are spaced apart to define gaps therebetween permitting uninterrupted air flow between the inside of said bottle and the ambient air. The tabs have free ends defining an opening and are sized and shaped to receive and hold a wick supporting tube having a longitudinal axis perpendicular to the horizontal plane and an upper end from which a wick projects. The tube is inserted into the opening so that the upper end is held in place at a given longitudinal distance from the lip. When said device is placed on the lip and the wick is lit, heat generated by the lighting heats the tube and the oil and causes the perfume to be released into the ambient air through the gaps.

The invention is also concerned with the combination of the device with an oil lamp to allow diffusion of the scent of a perfume added to the oil.

BRIEF DESCRIPTION OF THE DRAWINGS

The present invention and its advantages will be more easily understood after reading the following non-restrictive description of preferred embodiments thereof, made with reference to the following drawings where.

DESCRIPTION OF A PREFERRED EMBODIMENT OF THE INVENTION

Figure 1:
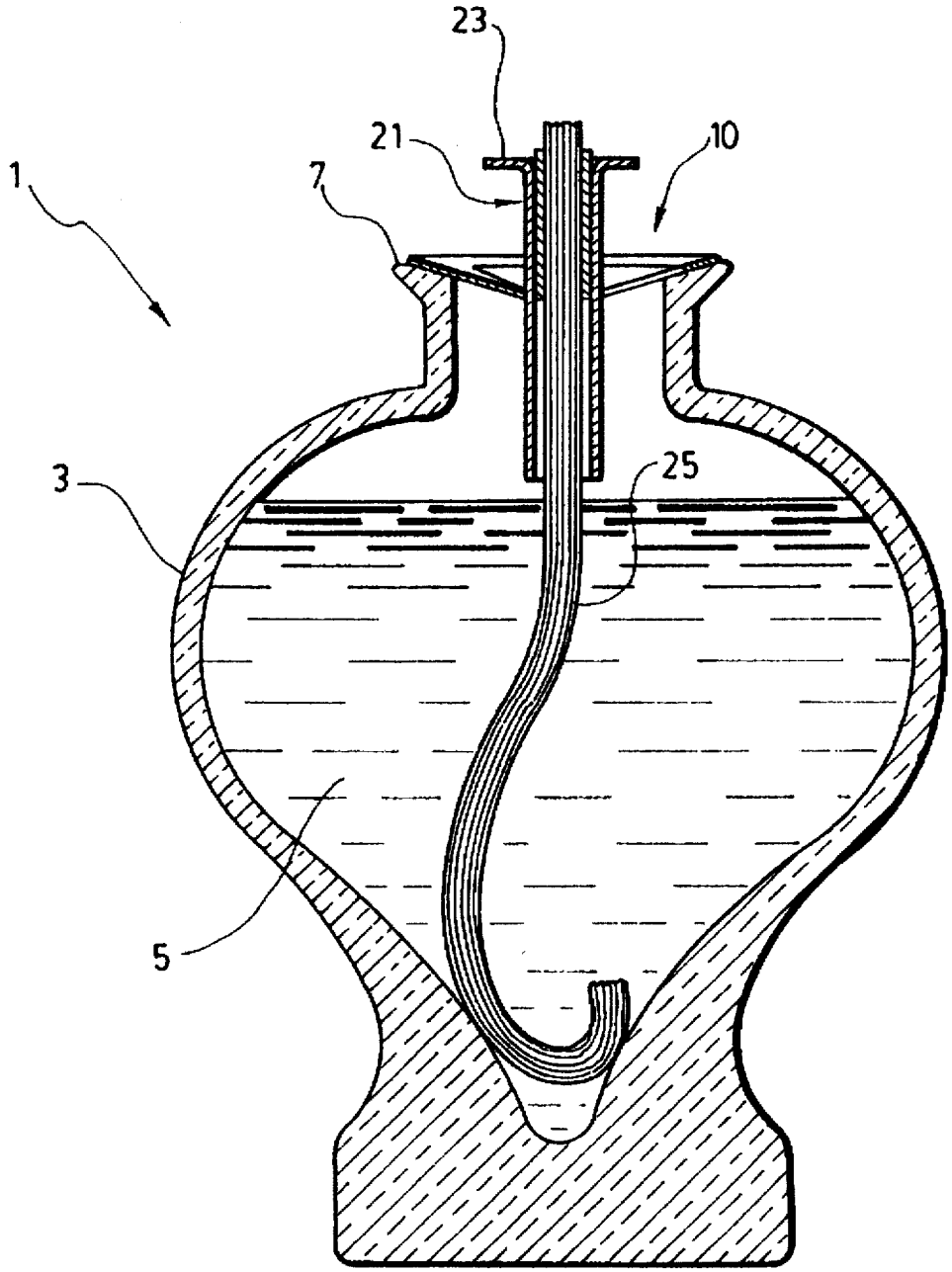
FIG. 1 is a cross-sectional view of an oil lamp with the device inserted between the tube and the glass bottle.

FIG. 1 shows an oil lamp 1 including a device 10 according to a preferred embodiment of the invention. The oil lamp 1 comprises a glass bottle 3 having an inside 5 and a lip 7 lying in a generally horizontal plane and a wick supporting tube 21, preferably made of glass, having a longitudinal axis perpendicular to the horizontal plane and an upper end 23 from which a wick 25 projects. Conventionnally, the glass bottle is filled with oil or liquid parrafin and the wick supporting tube 21 is placed on the lip 7 of the glass bottle 3 so that the wick 25 rests at the bottom of the glass bottle 3. The oil or liquid parrafin may further be scented so that a pleasing smell is released when the wick 25 is lit. Thus, the oil lamp advantageously comprises a device 10 according to the preferred embodiment of the invention to allow the diffusion of the scent of the perfume added to the oil or liquid paraffin.

Figure 2:
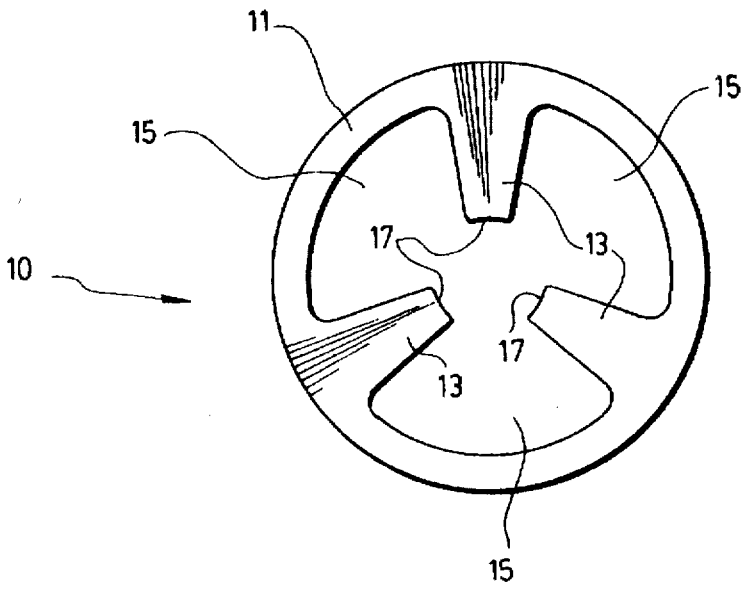
FIG. 2 is a top view of a preferred embodiment of the device.
Figure 3:
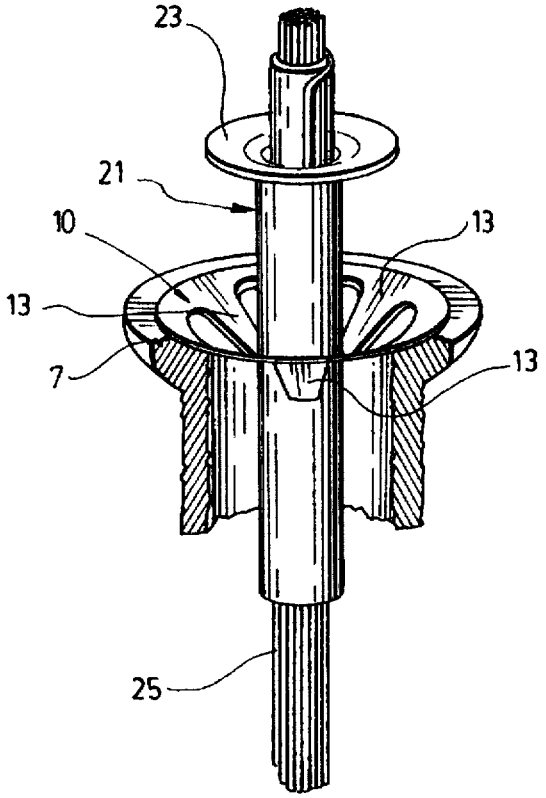
FIG. 3 is a perspective view of the device inserted between the glass bottle and the tube.

The device 10 according to the preferred embodiment of the invention is a ring-shaped element 11 having a plurality of inwardly, downwardly protruding tabs 13 that are spaced apart to define gaps 15 therebetween, as better seen on FIGS. 2 and 3. The gaps 15 permit uninterrupted air flow between the inside 5 of the glass bottle 3 and the ambient air.

The tabs 13 have free ends 17 defining an opening and are sized and shaped to receive and hold the wick supporting tube 21 so that when the wick supporting tube 21 is inserted into the opening, the upper end 23 is held in place at a given longitudinal distance from the lip 7 of the glass bottle 3 when the device 10 is placed on the lip 7 of the bottle 3 as shown on FIGS. 1 and 3. When the wick 25 is lit, heat generated by the flame heats the tube 21 and the oil, thereby creating an upward draft, and causes the perfume to be released into the ambient air through the gaps 15.

For purposes of stability, the device preferably comprises at least three tabs 13 which are equally spaced apart as shown on FIG. 2.

The device 10 according to the preferred embodiment of the invention has an outside diameter of 27 mm. Thus, the device may preferably be used with oil lamps having an inside diameter at the neck smaller than 27 mm. The ring-shaped element 11 of the device 10 is 2 mm wide and the three tabs 13 protruding inwardly extend 8 mm inside the device 10. The device 10 is preferably made of metal.

Ideally, a minimum space of 8 mm should be left between the device 10 and the upper end 23 of the tube 21, to permit uninterrupted air flow from the glass bottle 3 upward.

Although the present invention has been explained hereinabove by way of a preferred embodiment thereof, it should be pointed out that any modifications to this preferred embodiment within the scope of the appended claims is not deemed to alter or change the nature and scope of the present invention.

What is claimed is:

1. A device for use in an oil lamp having an inside and a lip, to allow the diffusion of the scent of a perfume added to the oil, said lip lying in a generally horizontal plane, said device comprising a ring-shaped element having a plurality of inwardly downwardly protruding tabs that are spaced apart to define gaps therebetween permitting uninterrupted air flow between the inside of said bottle and the ambient air, said tabs having free ends defining an opening and sized and shaped to receive and hold a wick supporting tube, said tube having a longitudinal axis perpendicular to said plane and an upper end from which a wick projects, said tube being inserted into said opening so that said upper end is held in place at a given longitudinal distance from said lip, whereby, in use, when said device is placed on said lip and said wick is lit, heat generated by said lighting heats said tube and said oil and causes said perfume to be released into the ambient air through said gaps.

2. A device according to claim 1, wherein said ring-shaped element has three inwardly downwardly protruding tabs equally spaced apart.

3. A device according to claim 2, wherein said ring-shaped element has an outside diameter of approximately 27 mm.

4. A device according to claim 3, wherein said tabs extend inwardly by a distance of at least 8 mm and said ring-shaped element has a width of approximately 2 mm.

5. A device according to claim 4, wherein said distance between said lip and said end is at least 8 mm.

6. An oil lamp having an inside and a lip lying in a generally horizontal plane, said oil lamp comprising a ring-shaped element placed on said lip, said ring-shaped element having a plurality of inwardly downwardly protruding tabs that are spaced apart to define gaps therebetween permitting uninterrupted air flow between said inside of said lamp and the ambient air, said tabs having free ends defining an opening and sized and shaped to receive and hold a wick supporting tube, said tube having a longitudinal axis perpendicular to said plane and an upper end from which a wick projects, said tube being inserted onto said opening so that said upper end is held in place at a given longitudinal distance from said lip, whereby, in use, when said oil lamp is filled with perfumed oil or liquid paraffin and said wick is lit, the heat generated by said lighting heat said tube and said oil and causes said perfume to be released into the ambient air through said gaps.

7. An oil lamp according to claim 6, wherein said ring-shaped element has three inwardly downwardly protruding tabs.

8. An oil lamp according to claim 7, wherein said ring-shaped element has an outside diameter of approximately 27 mm.

9. An oil lamp according to claim 8, wherein said tabs extend inwardly by a distance of at least 8 mm and said element has a width of approximately 2 mm.

10. An oil lamp according to claim 9, wherein said distance between said lip and said end is at least 8 mm.

* * * * *